US005364216A

United States Patent [19]

Mandel

[11] Patent Number: 5,364,216

[45] Date of Patent: Nov. 15, 1994

[54] APPARATUS FOR APPLYING A BINDING STRIP TO DOCUMENT SETS

[75] Inventor: Barry P. Mandel, Fairport, N.Y.

[73] Assignee: Xerox Corporation, Stamford, Conn.

[21] Appl. No.: 58,596

[22] Filed: May 7, 1993

[51] Int. Cl.[5] ..... B42B 5/00

[52] U.S. Cl. ..... 412/34; 412/33

[58] Field of Search ..... 412/6, 20, 33, 34, 16

[56] References Cited

U.S. PATENT DOCUMENTS

| | | | |
|---|---|---|---|
| 3,760,444 | 9/1973 | McNichol | 412/34 |
| 3,881,203 | 5/1975 | Giulie | 412/34 |
| 4,986,713 | 6/1989 | Zoltner et al. | 412/34 |
| 5,061,139 | 6/1989 | Zoltner | 412/8 |
| 5,066,182 | 9/1991 | Stonebraker et al. | 412/3 |
| 5,226,771 | 7/1993 | Gardner | 412/6 |

FOREIGN PATENT DOCUMENTS

| | | | |
|---|---|---|---|
| 783846 | 4/1968 | Canada | 412/34 |
| 3-270989 | 12/1991 | Japan | 412/33 |

*Primary Examiner*—Mark Rosenbaum
*Assistant Examiner*—S. Thomas Hughes
*Attorney, Agent, or Firm*—Fay, Sharpe, Beall, Fagan, Minnich & McKee

[57] ABSTRACT

An apparatus for use with xerographic equipment or the like automatically applies a plastic U-shaped spline binder strip from a cassette housing a plurality of strips onto a first edge of a document set clamped to a planar surface. A binding strip cassette storage holds a plurality of binding strips for single-file automatic installation onto a series of document sets generated by the xerographic equipment. A spreader member disposed between the cassette storage and the document set opens finger portions of the binding strip as it translates from the cassette and onto the document set.

27 Claims, 4 Drawing Sheets

APPARATUS FOR APPLYING A BINDING STRIP TO DOCUMENT SETS

BACKGROUND OF THE INVENTION

This invention is directed generally to the binding of bound or unbound generally aligned stacked sheets of paper. More particularly, the invention pertains to the art of binding apparatus and further to an apparatus for applying a U-shaped spline binding strip to an edge of a document set.

The invention is specifically adapted for use with xerographic equipment for on-line application of a plastic spline binder strip to a compiled document set during the finishing process and will be described with particular reference thereto. It will be appreciated, however, that the invention has broader application and can be used, for example, for applying plastic or metallic U-shaped strips to the perimeter of thick cardboard sheets or other sheet-type structures where rigidity is a concern.

Recent technology advances in the art of photo duplication apparatus have made it possible for low-end users to create handsome leaflets, reports, booklets and the like. Indeed, most business offices are equipped with at least one copy machine having both sort and staple features whereby large quantities of compiled document sets may be produced by relatively unskilled personnel in non-commercial printing operations.

Alternative binding methods have been proposed for providing a more pleasing finished appearance. Among the alternatives are included mechanical spline binder strips.

Heretofore, finishing processes using plastic or metallic U-shaped spline binder strips have been carried out off-line by office personnel away from the copy machine itself. Since the spline binder strips are compatible with staples, the document sets can be sorted and stapled at the copy machine and the binding strips are applied to the document set in a second manual operation. This two-step process wastes time and human resources.

Accordingly, there is a need for an automated binding process as an alternative or addition to the staple binding feature found in popular office copy machines. The automatic apparatus should desirably be flexible enough to accommodate various document sizes which may range from 2 to 300 or more sheets. Also, for large copy jobs, a reservoir of readily available U-shaped spline binder strips is desirable in order that the automated operation may proceed uninterrupted and unmanned. Lastly, the document sets must be bound efficiently and in a manner such that the sheets are relatively aligned and fastened to distribute the intersheet adhesion over a large binding area.

SUMMARY OF THE INVENTION

The present invention contemplates new and improved on-line binding methods and apparatus. The invention overcomes the above-referenced problems and provides end users with the ability to bind document sets through mechanisms other than staples or glues.

According to the present invention, an apparatus for applying a U-shaped spline binder strip to a document set is provided. The apparatus preferably includes a housing forming a document set stage and a binding strip stage connected to the housing for receiving a U-shaped spline binder strip thereon. An automatic means is provided for sliding the binder strip from the binding strip stage means. Also, a clamp apparatus is provided for securing the document set to the document set stage on the housing and, preferably, the document set stage is provided with at least one guide member for engaging the document set along at least one edge for alignment purposes.

According to a still another aspect of the invention, the binding apparatus includes a registration member located on the housing along an edge of the document set for maintaining the binding strip in engagement with the document set as the binding strip is moved from the binding strip stage and onto the document set. A first edge of the registration member forms a deflector to spread open the leading edge of the U-shaped strip before it reaches the document set.

According to a still further aspect of the invention, the binding strip stage is a removable cassette storage apparatus for storing a plurality of U-shaped spline binder strips which are individually dispensed onto the document set automatically. Means for automatically ejecting one of the plurality of binder strips from the cassette forming the binding strip stage means is included for automatic operation.

BRIEF DESCRIPTION OF THE DRAWINGS

For a better understanding of the invention, as well as other objects and further features thereof, reference is made to the following drawing and description.

DETAILED DESCRIPTION OF THE PREFERRED EMBODIMENTS

Figure 1:
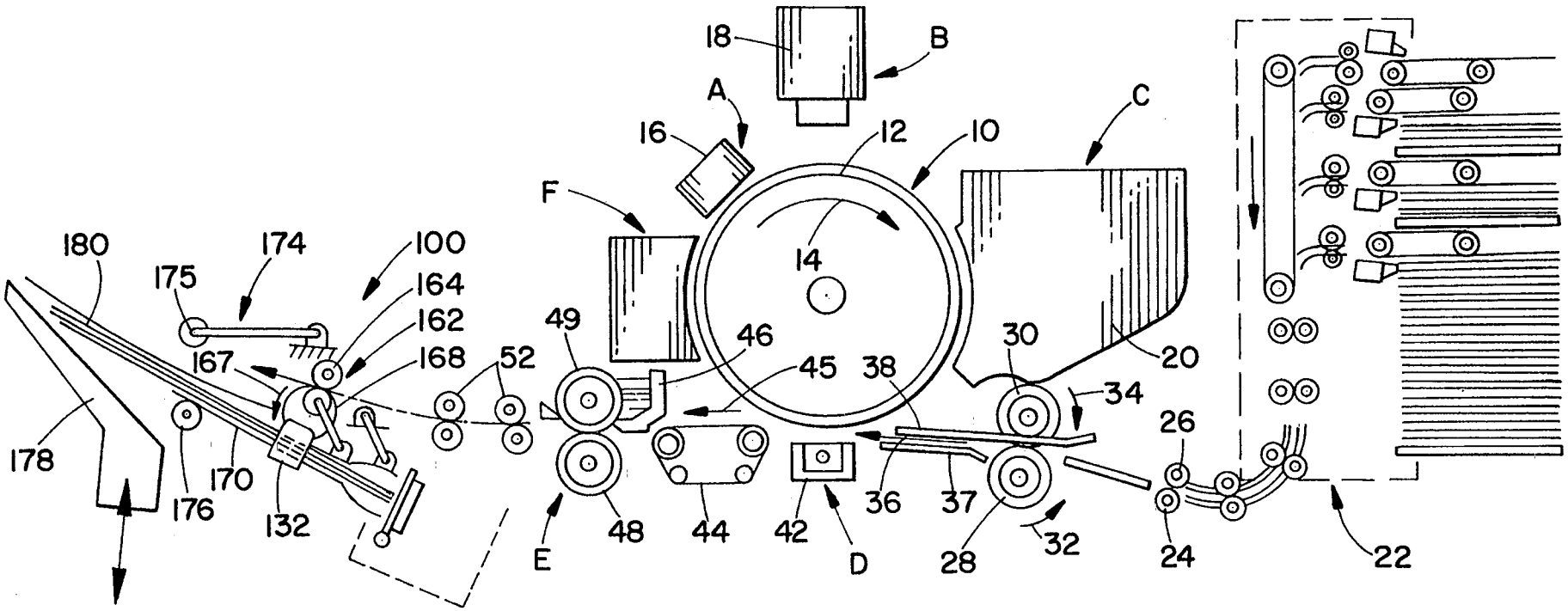
FIG. 1 is a schematic side elevational view depicting an illustrative electrophotographic printing machine incorporating the binding mechanism of the present invention.

Referring now to the drawings, wherein the showings are for purposes of illustrating the preferred embodiment of the invention only and not for the purposes of limiting same. FIG. 1 shows an electrophotographic printing machine in which the features of the present invention may be incorporated. For a general understanding of an electrophotographic printing machine, FIG. 1 depicts schematically the various components thereof. Hereinafter, like numerals will be employed throughout to designate identical elements. Although the apparatus for applying a binding strip to document sets is particularly well adapted for use in connection with electrophotographic printing machines, such as the one illustrated in FIG. 1, it should be evident from the following discussion that it is equally well suited in a wide variety of office machines and is not necessarily limited to the particular end-use shown herein.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 secured to the exterior circumferential surface of a conductive substrate is rotated in the direction of arrow 14. By way of example, photoconductive surface 12 may be made from selenium. A suitable conductive substrate is made from aluminum. Initially, drum 10 rotates a portion of photoconductive surface 12 through a charging station A. The charging station employs a corona generating device indicated generally by reference numeral 16 to charge photoconductive surface 12 to a relatively high, substantially uniform potential. Thereafter, a drum 10 rotates the charged portion of the photoconductive surface 12 to exposure station B. The latter includes an exposure mechanism indicated generally by the reference numeral 18 having a stationary transparent platen, such as a glass plate or the like, for supporting an original document thereon. Suitable lamps illuminate the original document. Scanning of the original document is achieved by a suitable oscillating mirror in a timed relationship with the movement of the drum 10 or by translating the lamps and lens across the original document so as to create incremental light images which are projected through a suitably arranged apertured slit into the charged portion of the photoconductive surface 12. Irradiation of the charged portion of the photoconductive surface 12 records an electrostatic latent image corresponding to the information areas contained within the original document.

Obviously, electronic imaging of page information could be facilitated by a printing apparatus using electrical imaging signals. The printing apparatus may be a digital copier including an input device, such as a raster input scanner (RIS) and a printer output device such as a raster output scanner (ROS).

Drum 10 rotates the electrostatic latent image recorded on photoconductive surface 12 to development station C. Development station C includes a developer unit indicated generally by the reference numeral 20 having a housing with a supply of developer mix contained therein. The developer mix comprises carrier granules with toner particles adhering triboelectrically thereto. Preferably, the carrier granules are formed from a magnetic material with the toner particles being made from a heat-settable plastic. The developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on the photoconductive surface 12.

A copy sheet is advanced by sheet feeding apparatus 22 which includes drive rolls 24 and 26 to a registration roller 28 and an idler roller 30. Registration roller 28 is driven by a suitable electric motor in the direction of arrow 32. The idler roller 30 rotates in the direction of arrow 34 since roller 28 is in contact therewith. In operation, the feed device 22 operates to advance the copy sheet from the tray through the guide along the path in which rolls 24 and 26 are located and then into registration rollers 28 and 30 such that the sheet is forwarded toward the drum 12 in synchronism with the image of the drum. The sheet is advanced in the direction of arrow 36 through a shute formed by guides 37 and 38 to a transfer station D.

The transfer station D includes a corona generating device 42 which applies a spray of ions to the backside of the copy sheet. This attracts the toner powder image from the photoconductive surface 12 to the copy sheet. After transfer of the toner powder image to the copy sheet, the sheet is advanced by an endless conveyor belt 44 in the direction of arrow 45 to a fusing station E. The fusing station includes a fuser assembly indicated generally by reference numeral 46. The fuser assembly 46 includes a fuser roll 48 and a backup roll 49 defining a nip therebetween through which the copy sheet passes. After the fusing process is completed, the copy sheet is advanced by pairs of discharge rollers 52 which may be of the same type as the registration rollers 24 and 26 to a binding apparatus indicated generally by the numeral 100 where a binding strip is applied to the document set thereat. The binding apparatus 100 includes a sheet discharge device, usually in the form of a drive nip assembly indicated generally by the reference numeral 162.

Figure 2:
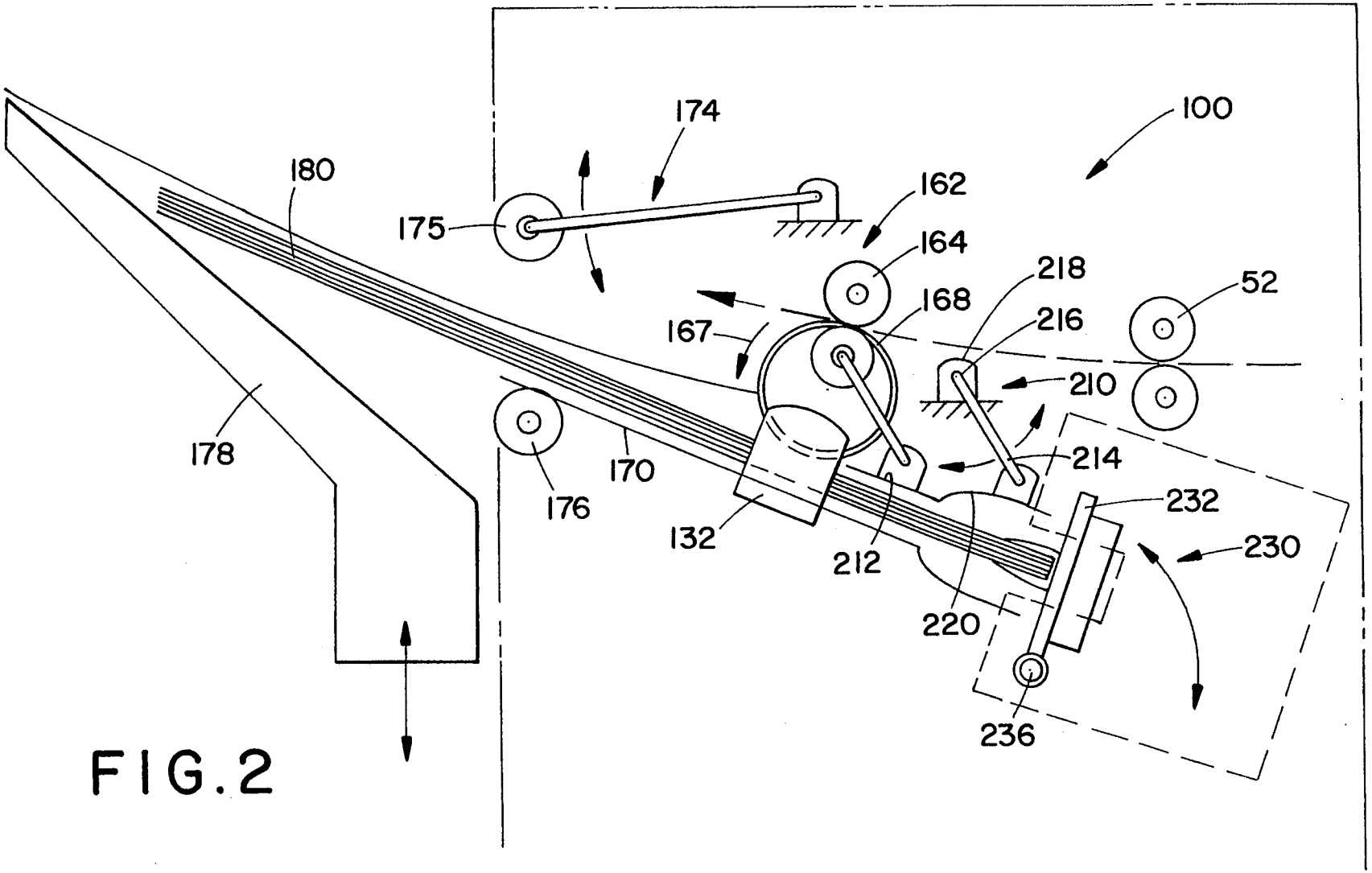
FIG. 2 is a side elevational view of the automatic binder apparatus of FIG. 1 in greater detail.

The drive nip assembly includes an idler 164 around which a longitudinal registration belt 168 is partially entrained as can be better seen in FIG. 2. The registration belt 168 is flexible and is advantageous that it provides a top active drive to the sheet being compiled. The belt moves in a direction generally indicated by the arrow 167. Therefore, the belt keeps the top sheet at the back registration wall thus providing the potential for very accurate registration. Also, such flexible belts allow the set height to increase, within limits, as sheets are compiled since the belts can easily deflect and still drive the sheets toward the back wall. In addition, the flexible belt has a very low lateral stiffness and, therefore, can easily deflect out of its plane as the sheets are side tamped by a tamper assembly 132. Because the belts are always rotating, once the top sheet reaches side registration and stops, the belts "walk" back to the equilibrium position awaiting the next sheet.

The binding apparatus further comprises a compiling tray 170, a compiled set discharge device 174, including a driven exit drive roll 175 and an idler exit drive roll 176 and an output elevator 178 providing a route for easy egress of the finished bound sheet sets 180. It is noted that both the compiling tray 170 and the output elevator 178 are both of "uphill" orientation having one edge, the edge nearest the discharge rollers 52 located at a lower elevation than the far edge.

Invariably, after the copy sheet is separated from the photoconductive surface 12, some residual toner particles remain adhered thereto. These toner particles are removed from the photoconductive surface 12 at a cleaning station F. The cleaning station includes a suitable corona generating device adapted to neutralize the remaining electrostatic charge on photoconductive surface 12 and that of the residual toner particles. The neutralized toner particles are then cleaned from the photoconductive surface 12 by a suitable rotatably mounted fibrous brush in contact therewith. Subsequent to cleaning, a suitable discharge lamp floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIGS. 2 and 3 illustrate the apparatus for applying a binding strip to document sets 100 in greater detail.

Figure 3:
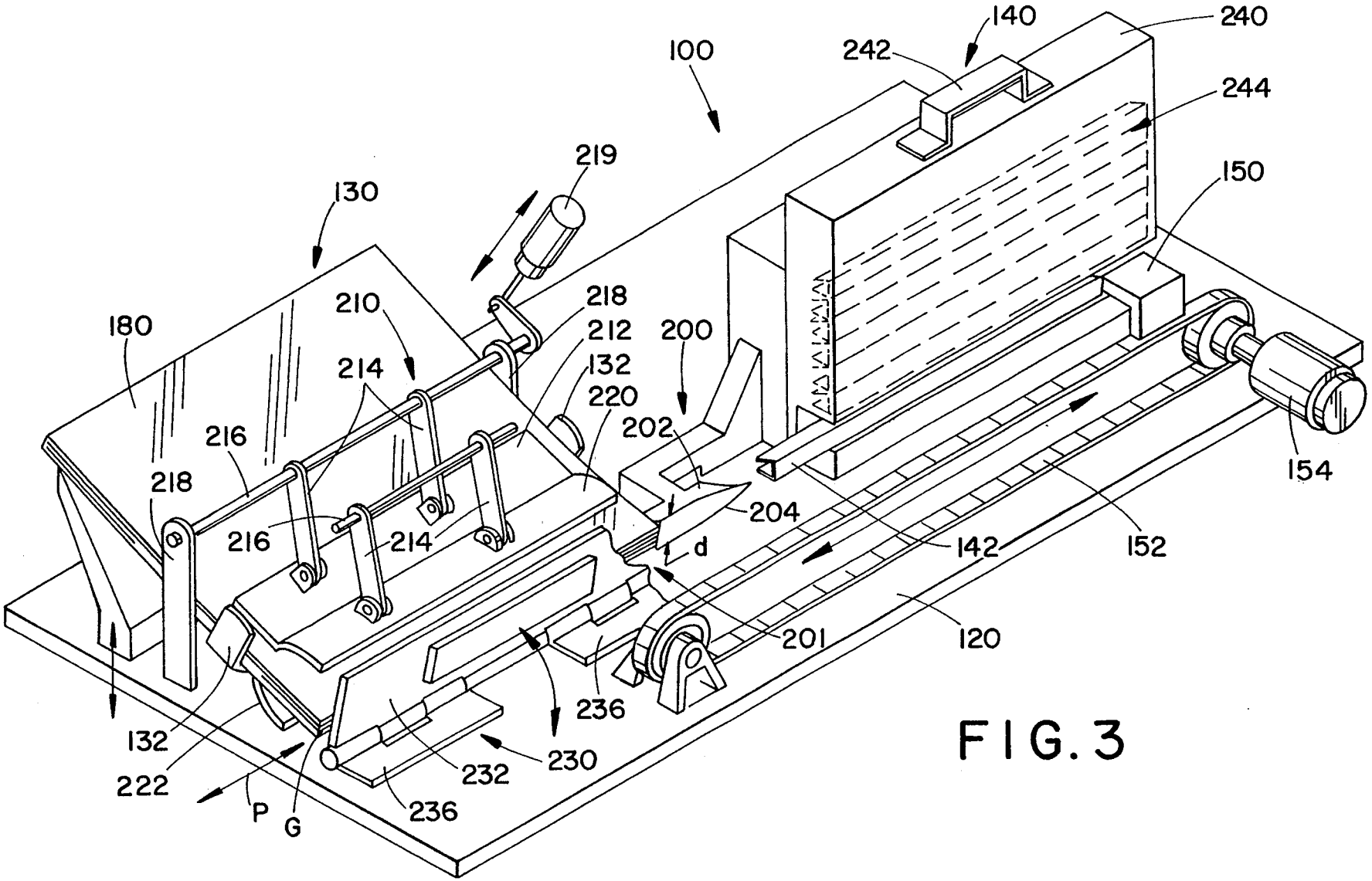
FIG. 3 is an isometric view of the apparatus of FIGS. 1 and 2 with a plastic U-shaped spline binder strip received on a document set; and, FIG. 4 is a schematic perspective view of an alternative spreader member for use with the apparatus of FIGS. 1-3.

FIGS. 2 and 3 show a binding apparatus 100 comprising a housing 120 which defines a document set stage means 130 in the form of a substantially planar platform. The plane of the platform is tilted or in an "uphill" orientation as described above. The document set stage means serves for closely receiving a document set 180 exposing a first edge G along a first path P. A binding strip stage 140 is connected to the housing 120 through mechanisms described in greater detail below and is suitably arranged for closely receiving a binding strip 142 thereon. A drive member 150 is connected to the housing 120 for selectively engaging the binding strip 142 and urging the strip from the binding strip stage 140 and onto the first edge G.

More particularly, with reference to FIGS. 2 and 3, the binding apparatus 100 has a housing or base portion 120 which is generally divided into two regions 130, 140. The document set stage 130 is generally planar, tilted and suitably arranged to closely receive a document set 180 thereon. The document set stage 130 is provided with a pair of tampers 132 which function to engage the document set 180 on opposing sides for the purpose of aligning the stack of sheets comprising the document set. One or more guide members may be included on the document set stage for aligning the edge of the document set opposite the first edge G.

Also connected to the housing 120 is a binding strip stage 140 adapted to receive a binding strip 142 thereon. As can be seen from the figures, the binding strip comprises a "U-shaped" spline binder strip which is preferably formed of an extruded resiliently biased plastic or similar material. As is apparent from the figures, the overall length of the U-shaped spline binder strip 142 is selected to correspond to the overall length of the first edge G of the document set 180. The cross sectional dimensions transverse the longitudinal axis of the strip are also carefully selected to correspond to the physical characteristics of the document set.

The binding strip stage 140 is advantageously arranged such that when positioned thereon, the longitudinal axis of the U-shaped spline binder strip coincides with the first edge G of the document set 180 defining the first path P. In this manner, urging the binder strip along the first path P toward the document set 180 is guaranteed to result in a meeting between the document set and the binding strip along the first edge G.

Figure 4:
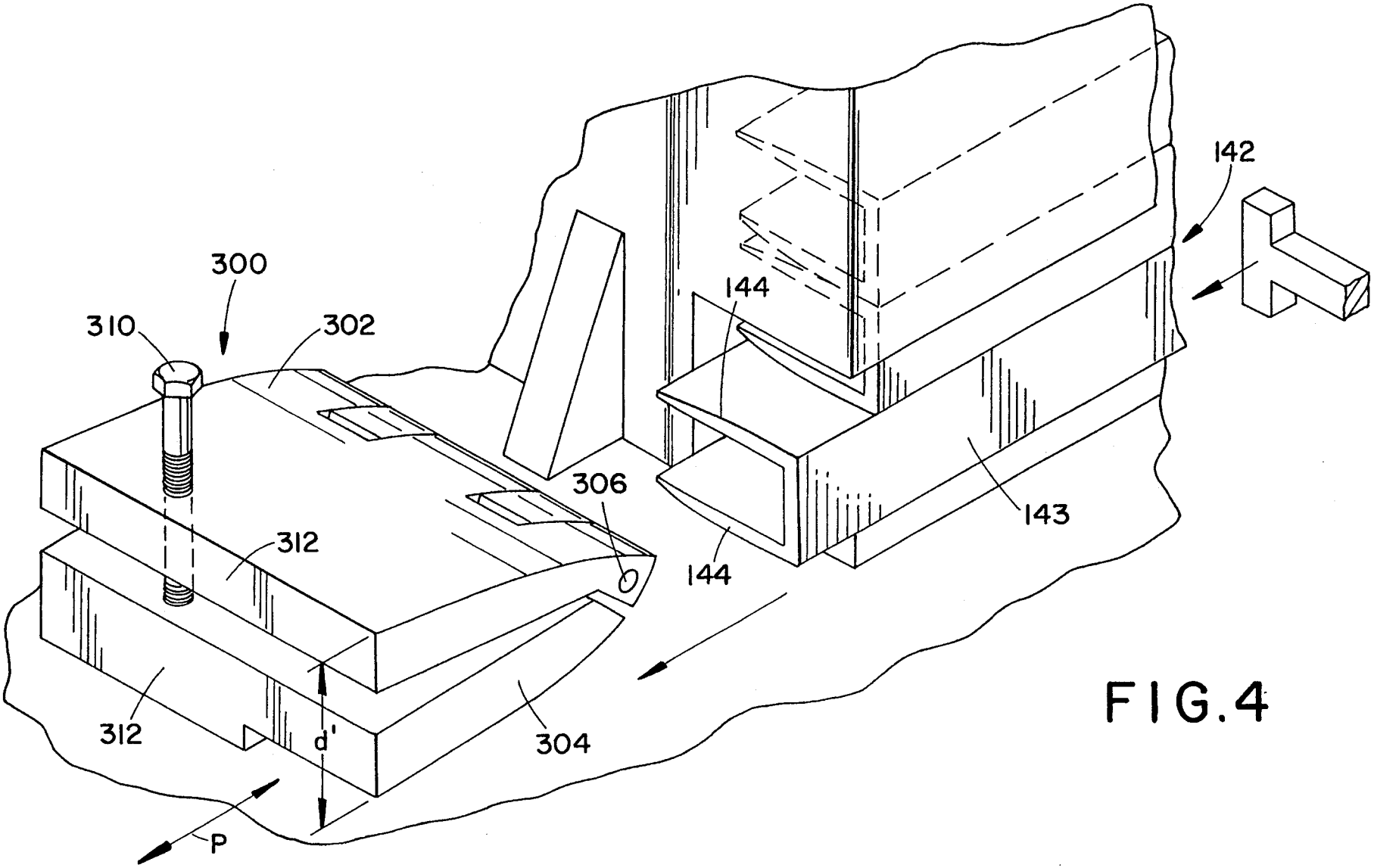

As indicated above, the U-shaped spline binder strip 142 is formed of a resiliently biased plastic material. With particular reference to FIG. 4, the binder strip includes a rigid spine portion 143 and a pair of longitudinally extending opposing finger members 144. When in a closed or unsprung position before installation on the document set, the extreme edges of the finger members are biased tending towards contact with each other for the longitudinal length of the binder strip. As illustrated in FIGS. 2 and 3, the separation between the extreme edges of the finger portions are selectable according to the thickness of the target document set 180 The proximate edges of the finger members 144 are fixed to and held in a spaced apart relationship by the spine 143. After installation on an edge of the document set, the finger members provide the necessary distributed intersheet binding force to hold the set together. FIG. 2 particularly illustrates that the thickness of the document set dictates somewhat the size of binder strip as suggested above. That is, the width of the spine member 143 must be selected to be somewhat greater than the thickness of the document set to be bound while the separation between the edges of the finger members must be somewhat less than the document set thickness. This difference is taken up by the the flex in the finger members 144.

Since the binder strip 142 is initially in the closed position described above, a spreader member 200 (FIG. 2) is provided between the document set stage 130 and the binding strip stage 140 in order to open the binder fingers 144 before they encounter the edge of the document set. The trailing edge of the spreader member is in intimate contact with the document set forming a contact surface 201. The spreader member 200 is connected to the housing 120 and includes a top ramp portion 202, a bottom ramp portion 204 and an exit dimension d. The top and bottom ramp portions of the spreader are suitably positioned along the first path P to engage the opposing finger portions 144 of the binding strip which are thereby appropriately spread open to receive the first edge of the document set. The dimension d of the spreader member 200 is large enough to permit opposing finger portions 144 to pass over the edge G as the binding strip is urged from the binding strip stage and onto the document set.

As described above, the binding strip 142 is positioned on the binding strip stage 140 until longitudinally motivated along the first path P by the drive member 150. As illustrated in the figures, a drive member 150 is connected to a drive belt 152 which in turn is driven by a stepper motor or servo motor mechanism 154. With reference in particular to FIG. 3, the drive member 150 connected to the drive belt 152 urges the binding strip 142 from the binding strip stage 140 when the stepper motor or servo motor 154 rotates.

With continued reference to FIGS. 2 and 3, the binding apparatus includes a clamp mechanism 210 for pressing the stacked document set 180 against the document set stage 130. The clamp mechanism includes a planar plate 212 connected to arms 214 as illustrated. The arms 214 are pivotally mounted to the plate 212 and are rotatable about shafts 216 which are connected on either end to a respective strut 218. The document set clamping force is provided by a solenoid, suitable stepper motor or servo mechanism 219. The planar plate 212 includes a clearance lip 220 along an edge so that the binding strip 142 and the drive member 150 do not interfere with the plate during use. With reference to FIG. 3, the document set stage 130 is similarly provided with a corresponding clearance lip 222.

With continued reference to FIGS. 2 and 3, a hinged registration member 230 is provided for maintaining the binding strip 142 positioned transversely of the first path P during movement of the strip from the binding strip stage 140 and onto the first edge G. The registration member 230 includes a plate 232 for engaging the spine 143 of the binding strip 142 and maintaining the binding strip position along the first path P as described above. The plate 232 is pivotally connected to the housing 120 through suitable hinges 236. Force is applied by the plate 232 against the binding strip using a spring, solenoid, suitable stepper motor or servo mechanism (not shown). A deflector may be provided on the lead edge (cut away in FIG. 3) of the plate 232 for use of the apparatus without the spreader member 200. The deflector engages the lead edge of the binder strip 142 at the spline 143 "opening" the binding strip by bending the spine toward the finger portions. The deflector transversely urges the spline off the path P which, in turn, causes the fingers 144 to spread open before the strip 142 reaches the document set 180.

With still further reference to the embodiment illustrated in FIGS. 2 and 3, the binding strip stage 140 comprises a cassette type storage housing 240 for containing a plurality of U-shaped plastic spline binder strips. The cassette housing 240 is suitably provided with a latch mechanism for connection to the binding strip stage. Also, a handle 242 is provided for easily removing the cassette housing 240 from the binding strip stage 140.

As illustrated in the figure, a plurality of U-shaped binder strips 244 are longitudinally oriented and arranged vertically in the cassette housing 240. In operation, a first document set is positioned on the document set stage 130 and clamped in place with the clamp assembly 210. Next, the drive member 150 pushes a first U-shaped binder strip from the cassette housing 240 and onto a first document set 180. The registration member 230 maintains the binder strip position transversely of the path P during movement of the strip. The drive member is then retracted to the position illustrated in the figure, permitting a second U-shaped binder strip to fall within the cassette 240 for subsequent installation on a second document set. In this manner, a plurality of document sets may be successively bound. A plurality of cartridges, each containing different commonly sized preformed plastic-spline binder strips may be kept ready at hand for binding differently sized document sets. The above arrangement provides for easy substitution of the cassette-type housing 240 for each job run.

With reference now to FIG. 4, an alternative structure is presented for the spreader member 200 illustrated in FIGS. 2 and 3. With reference to FIG. 4, an alternative spreader member 300 includes a top portion 302 and a bottom portion 304. The top and bottom portions are hinged at the front by a rod 306. The rod 306 is connected to the housing through the bottom portion 304 which is in turn fixed to the housing. The top and bottom portions of the spreader are suitably positioned along the first path P to engage the opposing finger portions 144 of the binding strip which are thereby appropriate spread open to receive the first edge of the document set. The dimension d' of the spreader member 300 is adjustable to be made large enough to permit the opposing finger portions 144 to pass over the edge G as the binding strip is urged from the binding strip stage and onto the document set.

In order to adjust the rear vertical dimension d' of the spreader member 300, a spreader bolt 310 is threadedly received in the top spreader member 302. The top spreader member 302 is hinged near the front as indicated above. The bottom spreader member 304 is affixed to the housing and maintained in a predefined position coinciding with the document set stage position. However, in order to accommodate various size document sets, the top spreader member 302 is threadedly movable as described above to provide for an adjustable rear vertical dimension d'. In either case, an appropriately sized binding strip 142 must be selected in order to insure that the finger portions 144 apply the necessary gripping force to the target document set. Also as above, the extreme edge of the top and bottom portions of the spreader member 300 are positioned so as to contact the document set at contact points 312.

The invention has been described with reference to the preferred embodiments. Modifications and alterations will occur to others upon reading and understanding the specification. It is my intention to include all such modifications and alterations in so far as they come within the scope of the appended claims or equivalents thereof.

Having thus described the invention, I now claim:

1. Apparatus for applying a U-shaped spline binder strip to a plurality of sheets comprising:

an alignment member forming the plurality of sheets into an aligned stacks by contacting an edge of each of the plurality of sheets thereby defining a first stack edge in contact with the alignment member;

a clamp assembly for clamping the aligned stack of sheets at a first location with the first stack edge substantially exposed along a first path;

a supply assembly for positioning a U-shaped spline binder strip at a second location in alignment with the first stack edge of the aligned stack of sheets, the supply assembly including a selectively operable pusher movable along said first path for moving the binder strip along said first path from the second location to said first location onto said first stack edge; and, a spreader means, located along the path between the first and second locations, for opening the U-shaped spline binder strip as it moves along said first path from the second location to the first location to allow the binder strip to receive the first stack edge.

2. Apparatus as defined in claim 1 wherein said alignment member includes means for maintaining the binder strip positioned transversely of the first path during movement of the strip from the second to the first location.

3. Apparatus as defined in claim 2 wherein the alignment member is mounted for movement at least in a direction transversely of the first path.

4. Apparatus as defined in claim 2 wherein the alignment member comprises a guide surface mounted for movement transversely of the first path toward the first location.

5. Apparatus as defined in claim 1 wherein the supply assembly includes storage means for storing a quantity of the U-shaped spline binder strips adjacent the second location for sequential movement to the second location.

6. Apparatus as defined in claim 5 wherein the storage means comprises a housing for holding the quantity of U-shaped spline binder strips in stacked relationship for movement by gravity to the second location.

7. Apparatus as defined in claim 1 wherein the spreader means comprises a blade member positioned to enter the U-shaped binder strip and open the strip to allow the first stack edge to enter therein.

8. Apparatus for applying a spline binder strip to a plurality of sheets comprising:

an alignment member in contact with each of the plurality of sheets to thereby form a stack of sheets aligned along a first edge in contact with the alignment member;

a clamp assembly for clamping the aligned stack of sheets at a first position with the first edge exposed along a first path;

a supply assembly for positioning a spline binder strip at a second location in alignment with the first edge of the aligned stack of sheets at the first location;

a spreader for opening the spline binder strip to allow it to receive the first edge of the aligned stack of sheets; and a pusher means for producing relative movement along said first path between the aligned stack of sheets at the first location and the spline binder strip at the second location to cause the first edge of the aligned stack of sheets to enter the opened spline binder strip.

9. The apparatus as defined in claim 8 wherein the spreader is held stationary and the pusher means includes means for moving the spline binder strip over the stationary spreader along said first path.

10. The apparatus as defined in claim 9 wherein the spreader is mounted along said first path between the first and second locations.

11. The apparatus as defined in claim 10 wherein the pusher means engages the binder strip at the second location and moves it along said first path to the first location.

12. The apparatus as defined in claim 8 wherein said alignment member includes means for maintaining the binder strip at the second location in alignment with the first edge of the aligned stack of sheets at the second location during the relative movement produced by the pusher means.

13. The apparatus as defined in claim 12 wherein the alignment member comprises a guide surface mounted for movement transversely of the path.

14. An apparatus for applying a binding strip to a first edge of a stacked document set, the apparatus comprising:

a housing;

a registration member in intimate contact with said stacked document set to thereby form a stacked document set having a first edge in contact with the member;

document set stage means formed by the housing for closely receiving the document set at a first position exposing said first edge along a first path;

binding strip stage means connected to the housing for closely receiving the binding strip thereon; and, drive means connected to the housing for selectively engaging the binding strip and urging the strip from the binding strip stage means and onto said first edge.

15. The apparatus according to claim 14 further comprising clamp means connected to the housing for pressing the stacked document set against the document set stage means.

16. The apparatus according to claim 4 further comprising clamp means connected to the housing for pressing the stacked document set against the document set stage means.

17. The apparatus according to claim 14 further comprising spreader means on the housing in said first path between the document set stage means and the binding strip stage means for opening the binding strip as it is urged from the from the binding strip stage means and onto said first edge.

18. The apparatus according to claim 14 wherein said registration member includes means, located along said first path adjacent the first edge, for maintaining the binding strip positioned transversely of first path during movement of the strip from the binding strip stage means and onto said first edge.

19. The apparatus according to claim 18 wherein said registration member includes means mounted for movement at least in a direction transversely of said first path.

20. The apparatus according to claim 14 wherein:

said binding strip stage means comprises a binding strip cassette storage means for containedly receiving a plurality of binding strips therein; and said drive means comprises means for selectively engaging a one of the plurality of binding strips and urging said one strip from the cassette storage means and onto said first edge.

21. The apparatus according to claim 20 wherein said document stage means includes at least one guide means for engaging said document set along at least one second edge.

22. The apparatus according to claim 21 further comprising clamp means connected to the housing for pressing the stacked document set against the document set stage means.

23. The apparatus according to claim 22 further comprising spreader means on the housing in said first path between the document set stage means and the binding strip stage means for opening a first binding strip as it is urged from the from the binding strip stage means and onto said first edge.

24. The apparatus according to claim 20 further comprising spreader means on the housing in said first path between the document set stage means and the binding strip stage means for opening a first binding strip as it is urged from the from the binding strip stage means and onto said first edge.

25. The apparatus according to claim 24 wherein said registration member includes means, located along said first path adjacent the first edge, for maintaining the first binding strip positioned transversely of first path during movement thereof from the binding strip stage means and onto said first edge.

26. The apparatus according to claim 25 wherein said registration member is mounted for movement at least in a direction transversely of said first path.

27. The apparatus according to claim 25 wherein said spreader means comprises a first surface on said registration member for contacting and opening the first binding strip as it is urged from the binding strip stage means and onto said first edge.

* * * * *